US007147100B1

(12) United States Patent
Borg

(10) Patent No.: US 7,147,100 B1
(45) Date of Patent: Dec. 12, 2006

(54) MULTIPLE-BOTTLE SECUREMENT AND CARRYING DEVICE

(75) Inventor: Zakary James Borg, Eugene, OR (US)

(73) Assignee: Oregon Precision Industries, Inc., Bend, OR (US)

( * ) Notice: Subject to any disclaimer, the term of this patent is extended or adjusted under 35 U.S.C. 154(b) by 0 days.

(21) Appl. No.: 11/199,671

(22) Filed: Aug. 9, 2005

(51) Int. Cl.
*B65D 75/00* (2006.01)

(52) U.S. Cl. ..... 206/150; 206/151; 294/87.2; 294/159

(58) Field of Classification Search ..... 206/150, 206/162, 141, 148, 163, 164, 159, 427, 151; 294/87.2, 159
See application file for complete search history.

(56) References Cited

U.S. PATENT DOCUMENTS

| | | | | |
|---|---|---|---|---|
| 3,003,805 | A * | 10/1961 | Glazer | 294/87.2 |
| 3,036,853 | A * | 5/1962 | Glazer | 294/87.2 |
| 4,093,295 | A * | 6/1978 | Erickson | 294/87.2 |
| 5,487,581 | A * | 1/1996 | Carmo et al. | 294/159 |
| 5,507,544 | A * | 4/1996 | McQuade et al. | 294/159 |
| 5,882,057 | A * | 3/1999 | Fahy | 294/159 |
| 6,334,531 | B1 * | 1/2002 | Valkovich | 206/163 |

* cited by examiner

*Primary Examiner*—Luan K. Bui
(74) *Attorney, Agent, or Firm*—Chernoff, Vilhauer, McClung & Stenzel, LLP

(57) ABSTRACT

A multiple-node clip-type bottle securement and carrier device is disclosed.

10 Claims, 3 Drawing Sheets

MULTIPLE-BOTTLE SECUREMENT AND CARRYING DEVICE

BACKGROUND OF THE INVENTION

The invention is directed to a device for securing together and carrying two or more bottle-like containers, with large or irregular dispensing caps, such as pump-spray bottles. In the case of pump-spray bottles in particular, such bottles cannot be secured together at the necks by handles that apply from above with a downward motion. What is needed is a handle that may be applied laterally.

BRIEF SUMMARY OF THE INVENTION

The present invention provides a device for securing together and carrying two or more bottles by their necks, the device being capable of releasably engaging the bottles in the vicinity of their necks by the application of a relatively small lateral force.

DETAILED DESCRIPTION OF PREFERRED EMBODIMENT

Figure 1:
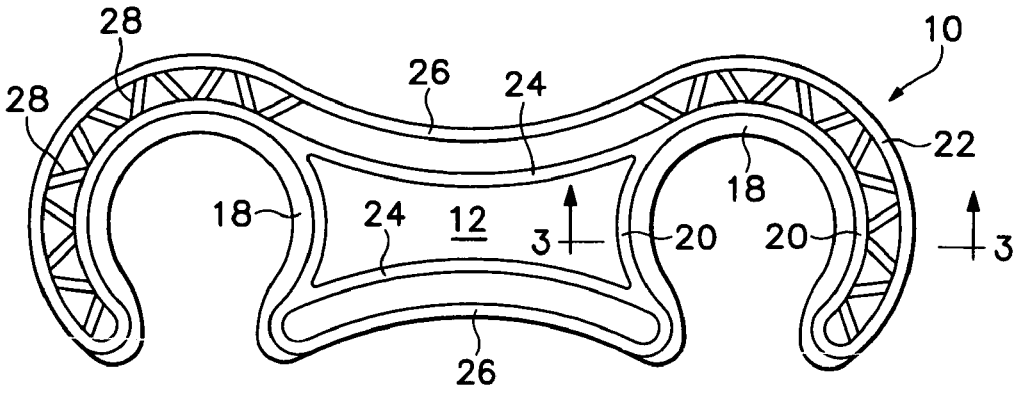
FIG. 1 is a plan view of an exemplary carrier of the invention.
Figure 2:
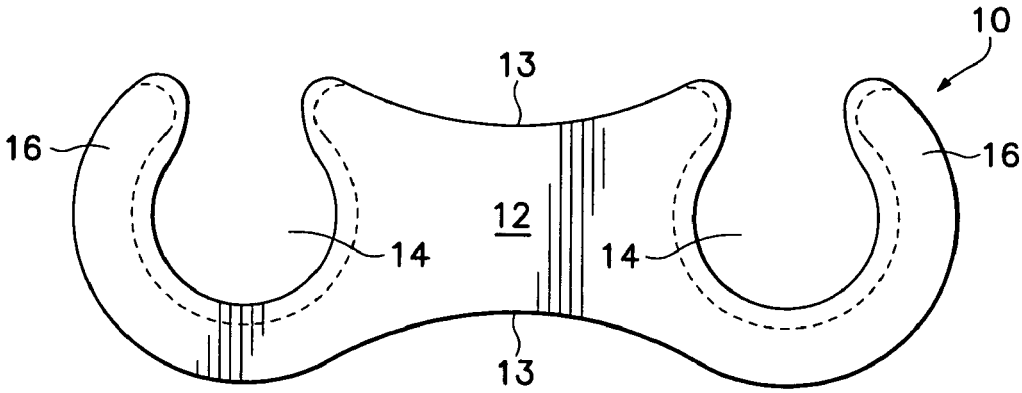
FIG. 2 is an underside view of the carrier of FIG. 1.

Referring to the drawings, wherein like numerals generally refer to the same elements, there is shown in FIGS. 1–6 an integral carrier 10 for carrying two bottle-like containers. Carrier 10 has a web 12 that is substantially planar. Web 12 has an inwardly radiused bridging portion 13 and pair of C-shaped support openings 14. Each support opening 14 has a pair of C-shaped neck-engaging structures 16 with an inwardly projecting flange 18 for releasably engaging the necks 29 of containers 30 either just below their caps or just below their neck flanges. Each neck-engaging structure 16 has a pair of ribs 20 and 22 along their inner and outer peripheries.

Bridging portion 12 is preferably provided with support ribs 24 and 26 that interconnect with ribs 20 and 22 on the closed sides of the C-shaped neck-engaging structure 16. These interconnecting ribs 20, 22, 24 and 26 add dimensional support to the carrier, much like I beams in a framed structure. The upper and lower surfaces of ribs 24 and 26 are preferably radiused to provide comfortable gripping surfaces for carrying the containers by the carrier. Each neck-engaging structure 16 preferably also has a plurality of cross-struts 28 between ribs 20 and 22, preferably arranged in a V-shaped pattern, to provide additional strength.

Figure 3:
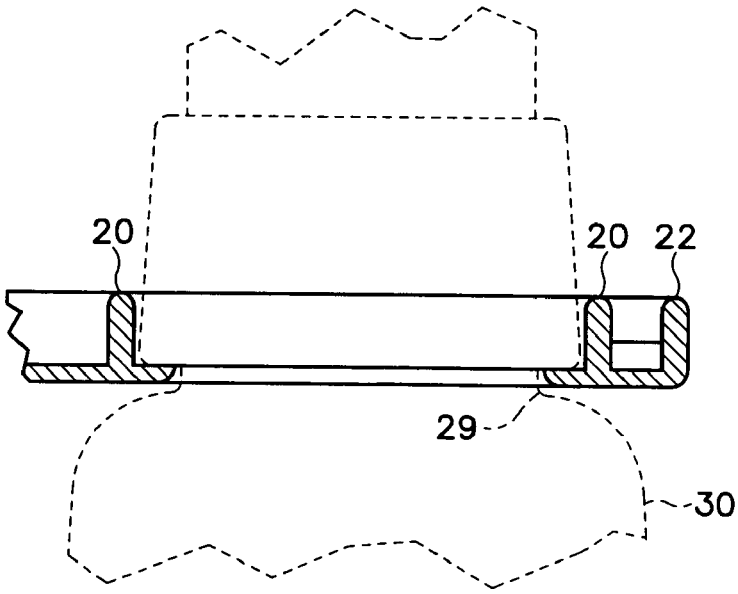
FIG. 3 is a sectional view of the carrier of FIG. 1 taken through the plane 3—3, as applied to a bottle without a flange on its neck.
Figure 4:
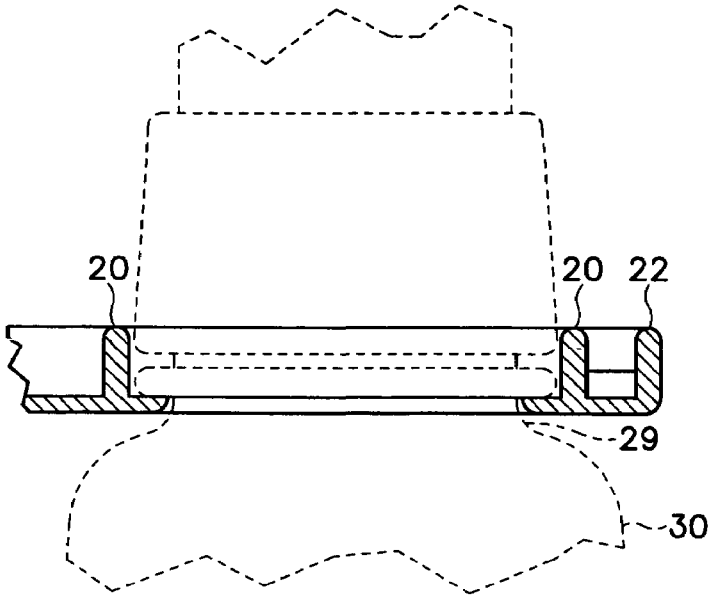
FIG. 4 is a sectional view of the carrier of FIG. 1 taken through the plane 3—3, as applied to a bottle with a flange on its neck.
Figure 5:
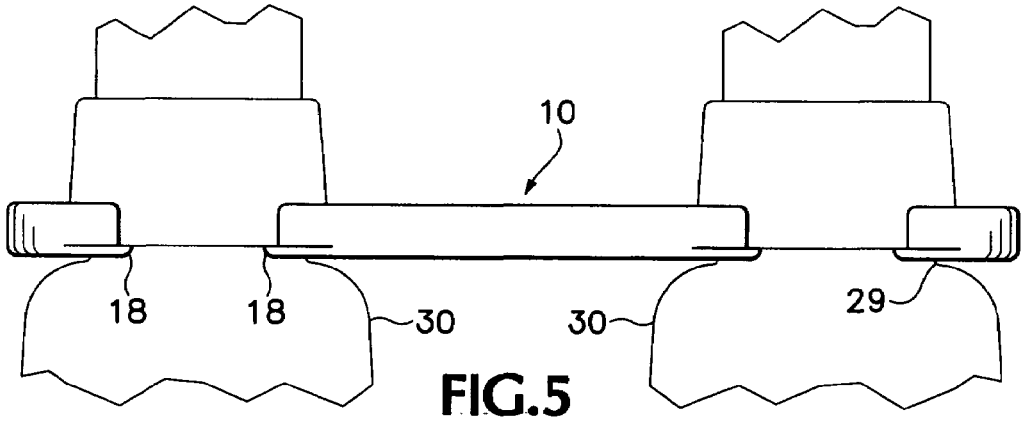
FIG. 5 is a side view of the carrier of FIG. 1 shown in place on two bottles without flanges on their necks.
Figure 6:
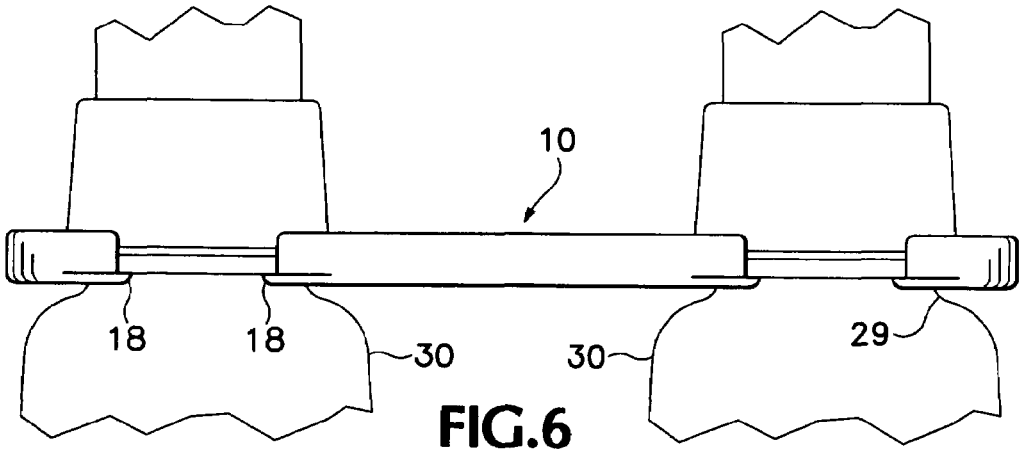
FIG. 6 is a side view of the carrier of FIG. 1 shown in place on two bottles with flanges on their necks.
Figure 7:
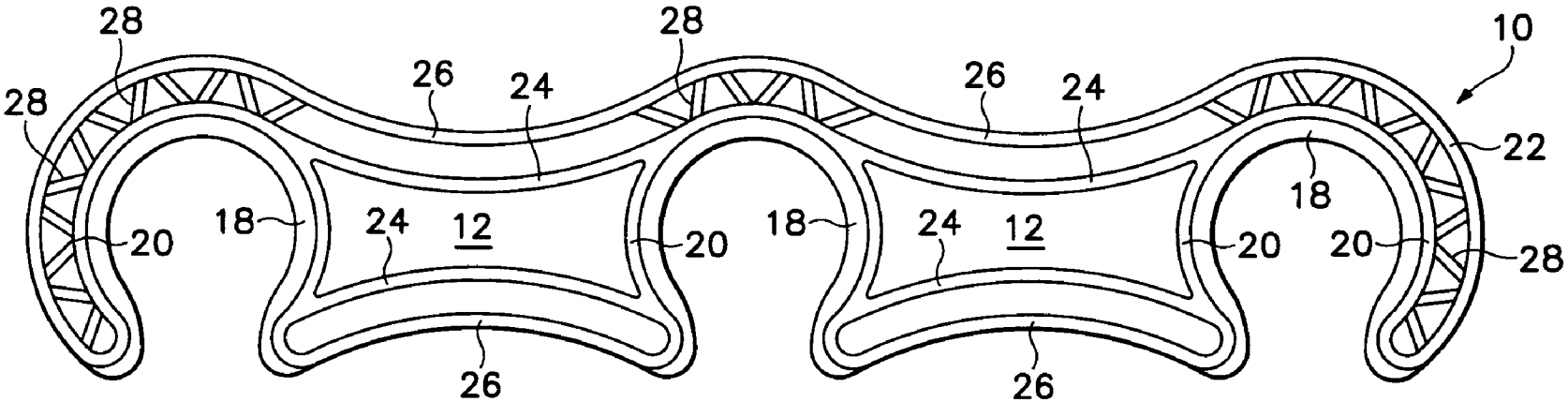
FIG. 7 is a plan view of an exemplary three-bottle carrier of the invention.

The inner edges of flanges 18 form a semi-circle and engage the necks 29 of the containers 30, allowing carrier 10 to secure and support the containers. The engagement of flanges 18 with bottle necks 29 is either just below the bottle cap (as shown in FIGS. 3 and 5) or, in the case of bottle necks with built-in flanges, just below the bottle neck flanges (as shown in FIGS. 4 and 6). The leading edge of flange 18 engages the bottle neck prior to the widening of neck-engaging structure 16, so as to guide the flange into place during application.

The carrier is manufactured using high pressure injection molding of heated and liquefied polymer into a three-dimensional cavity, and is preferably made of a flexible material such as a polyolefin. In a most preferred embodiment, the polyolefin is high density polyethylene (HDPE) that has a tensile strength from about 4000 to about 5000 psi, a flexural strength of at least 65 psi and a brittleness temperature of less than −30° C. This material is readily recyclable. The carrier is essentially planar and so does not obscure the container or product therein or labels, but instead provides high product and label visibility.

The carrier is readily applied to the containers by simply pushing it laterally against the container neck which causes the C-shaped neck engaging structures 16 to widen slightly to accommodate the neck, and continuing the application of lateral force until the flanges 18 snap into place either just below the container's cap or below a flange in the neck of the container, to the extent one exists.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. An integrally molded carrier for securing together and carrying at least two containers by their necks, comprising:

(a) a substantially planar web having a top surface and a bottom surface, said web defining at least two C-shaped neck-engaging structures joined together by a bridging portion having a front side and a back side, said neck-engaging structures and said bridging portion having a pair of support ribs along their peripheries; and (b) wherein each of said neck-engaging structures has a flange projecting inwardly for releasably engaging the necks of said containers and said flange is substantially aligned with said bottom surface; and (c) wherein each of said front side and said back side of said bridging portion are substantially symmetrically inwardly radiused.

2. The carrier of claim 1 wherein each of said neck-engaging structures has integrally molded cross-struts between said support ribs.

3. The carrier of claim 2 wherein said cross-struts are along said top surface.

4. The carrier of claim 3 wherein said cross-struts are substantially in a V-shaped pattern.

5. The carrier of claim 4 wherein said flange protrudes to engage the necks of said containers below their caps immediately prior to full application.

6. The carrier of claim 5 wherein said containers are spray bottles.

7. The carrier of claim 6 secured to the necks of said spray bottles.

8. The carrier of claim 4 formed of a flexible material.

9. The carrier of claim 7 wherein said flexible material is high density polyethylene.

10. The carrier of claim 8 wherein said polyethylene is recyclable.

* * * * *